US007554506B2

(12) United States Patent
Chung et al.

(10) Patent No.: US 7,554,506 B2
(45) Date of Patent: Jun. 30, 2009

(54) FULL BAND SLEEVE MONOPOLE ANTENNA WITH EQUIVALENT ELECTRICAL LENGTH

(75) Inventors: Tsung-Ying Chung, Taipei Hsien (TW); Chang-Hsiu Huang, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 1 day.

(21) Appl. No.: 12/049,380

(22) Filed: Mar. 17, 2008

(65) Prior Publication Data

US 2008/0252542 A1 Oct. 16, 2008

(30) Foreign Application Priority Data

Apr. 11, 2007 (TW) ..... 96205768 U

(51) Int. Cl.
*H01Q 9/04* (2006.01)

(52) U.S. Cl. ..... 343/790; 343/700 MS; 343/895

(58) Field of Classification Search ..... 343/790, 343/791, 792, 700 MS, 895
See application file for complete search history.

(56) References Cited

U.S. PATENT DOCUMENTS 5,231,412 A * 7/1993 Eberhardt et al. ..... 343/790
6,963,313 B2 * 11/2005 Du ..... 343/790
7,193,566 B2 * 3/2007 Chen et al. ..... 343/700 MS
7,365,688 B2 * 4/2008 Tseng et al. ..... 343/700 MS

* cited by examiner

*Primary Examiner*—Hoang V Nguyen
(74) *Attorney, Agent, or Firm*—Winston Hsu

(57) ABSTRACT

An inductance is coupled to the radiator and a set of inductances is coupled to the sleeve for increasing the resonant electrical lengths of the radiator and the sleeve. A set of impedances is coupled to the sleeve to absorb the reflective power of the radiator for increasing the bandwidth of the antenna. The winding layout of radiator and sleeve and the disposition of passive elements (such as inductance and resistance) allow the sleeve monopole antenna with full band FM radiation to have small size.

9 Claims, 7 Drawing Sheets

FCC lab transmission test (dBuV)

| Frequency / Type | 88.1MHz | 98.1MHz | 107.9MHz |
|---|---|---|---|
| Conventional small FM antenna | 49.1 | 65 | 64.9 |
| Sleeve monopole antenna of the present invention | 75.7 | 76.1 | 79 |

Fig. 6

FULL BAND SLEEVE MONOPOLE ANTENNA WITH EQUIVALENT ELECTRICAL LENGTH

BACKGROUND OF THE INVENTION

1. Field of the Invention

The present invention relates to a sleeve monopole antenna, and more specifically, to a full band sleeve monopole antenna with equivalent electrical length.

2. Description of the Prior Art

Digital multimedia applications such as MP3 player, satellite broadcasting, and Hi-Fi digital broadcasting have extended the application from personal usage with portability to mobile application due to a higher demand for a comfortable, digitalized driving environment of mobile industry. Therefore, today the broadcasting system in a mobile is more about receiving multimedia signals from different multimedia equipments than just receiving broadcasting signals from radio frequency modulation (FM) signals. To fit in to the prior art mobile FM radio system, more and more digital multimedia applications have built-in FM transmitter so that the music in digital form can be transformed into FM signals and transmitted to the mobile FM radio system.

A prior art FM antenna transmits FM signals with monofrequency or with high transmission power and has small size to be carried and easily disposed on the vehicle. Considering the bandwidth of the signals with return loss less than −10 dB, such kind of FM antenna commonly has effective bandwidth of 2~5 MHz and is not suitable for mobile FM radio system. It is therefore a convenient advancement that the FM transmitter has the ability to transmit signals with full bandwidth (88~108 MHz) and the FM antenna has corresponding feature of transmitting signals with 88~108 MHz bandwidth. The early FM antenna with 20 MHz bandwidth is accomplished by a monopole antenna with ¼ wavelength (about 75 cm) accompanied by a large ground end, for example, a ground end with area larger than 2 wavelength square, or a sleeve monopole antenna with length about 100 cm. However, the antennas above are too large to be installed on a vehicle.

Conforming to transmission regulations on FM bandwidth by Federal Communications Commission (FCC), the FM radiator of the FM transmitter must be placed as close as possible to the FM receiver because of the restriction of transmission power. Generally the FM receiver of the mobile FM audio system is disposed at the tail of a vehicle and the FM radiator is disposed at the rear window by connecting a 3-meter coaxial cable, which is buried under the seats or the carpet for outlook reason. Most FM radiators can be classified into two types: chip antenna or a 30 cm copper wire wrapped on a ferrite core collocating with the coaxial cable. Either type has a small size but the bandwidth of transmission is narrow and not uniform. For frequency sections that have impedance mismatching, part of the power reflects back to the coaxial cable when transmitted by the FM transmitter to the FM radiator through the coaxial cable. The reflected power is transmitted by the copper screen again but is shielded by the body of the vehicle, which brings waste of power to the FM radiator.

Please refer to FIG. 1. The sleeve monopole antenna 10 according to the prior art comprises a radiator 12 and a sleeve 14 (for grounding). The radiator 12 has a length of ¼ wavelength and the sleeve 14 provides route for the inverse phase signals of the radio signals. In other word, the sleeve monopole antenna 10 is a transformation of a dipole antenna and the sleeve 14 provides impedance matching and collaboration of the bandwidth for the radiator 12. To convert the phase of the signals, the length L of the sleeve 14 and the distance Rx between the sleeve 14 and the radiator 12 are important factors where the input impedance of the sleeve monopole antenna 10 depends on Rx and L determines the phase of the signals. It is a common practice to set the length L of the sleeve 14 as ⅛ to ¼ wavelength to provide signals with phase 180 degree. Furthermore, the sleeve 14 functions as a balun (balance-unbalance converter) to convert the one-way unbalanced signals into two-way out-of-phase signals where one way for the radiator 12 and the other way for a ground plane large enough or another radiator with ¼ wavelength.

Please refer to FIG. 2. A printed sleeve monopole antenna 20 according to the prior art winds the radiator 22 to reduce the dimension. However, the overall size of the prior art sleeve monopole antenna 20 cannot be further minimized since the length L of the sleeve 24 remains between ⅛ to ¼ wavelengths that is why the prior art antenna 20 has difficulty to be implemented on mobile FM broadcasting system.

SUMMARY OF THE INVENTION

The present invention provides a full band sleeve monopole antenna with equivalent electrical length. The sleeve monopole antenna comprises a radiator having a plurality of winding sections and for transmitting a radio signal, a ground element for providing route for the inverse phase signal of the radio signal and having a plurality of winding sections, a first end, and a second end, a first matching element disposed at one end of the radiator, a second matching element disposed at one end of the ground element, and a third matching element coupled between the first end and the second end of the ground element for providing an impedance.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 6 is an illustration of transmission power among different frequencies of a conventional small FM antenna and the sleeve monopole antenna of the present invention.

DETAILED DESCRIPTION

Figure 3:
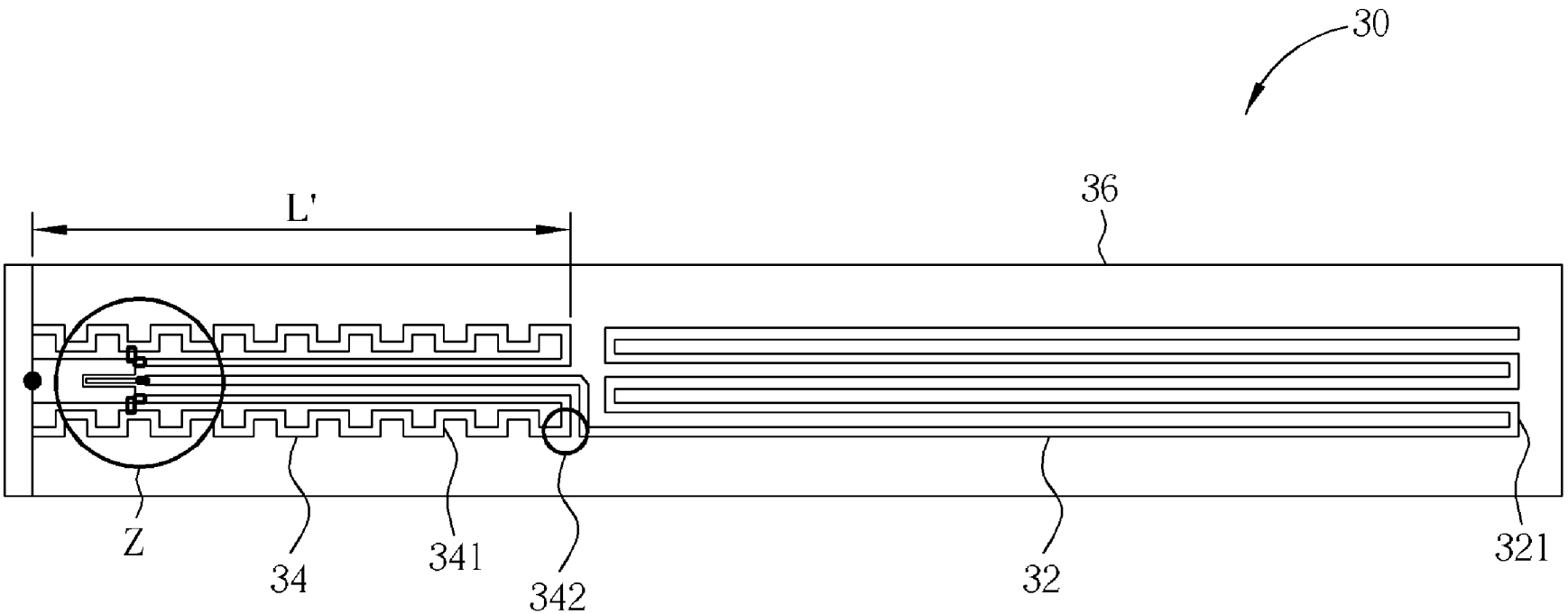
FIG. 3 is an illustration of an exemplary embodiment of the printed sleeve monopole antenna according to the present invention.
Figure 4:
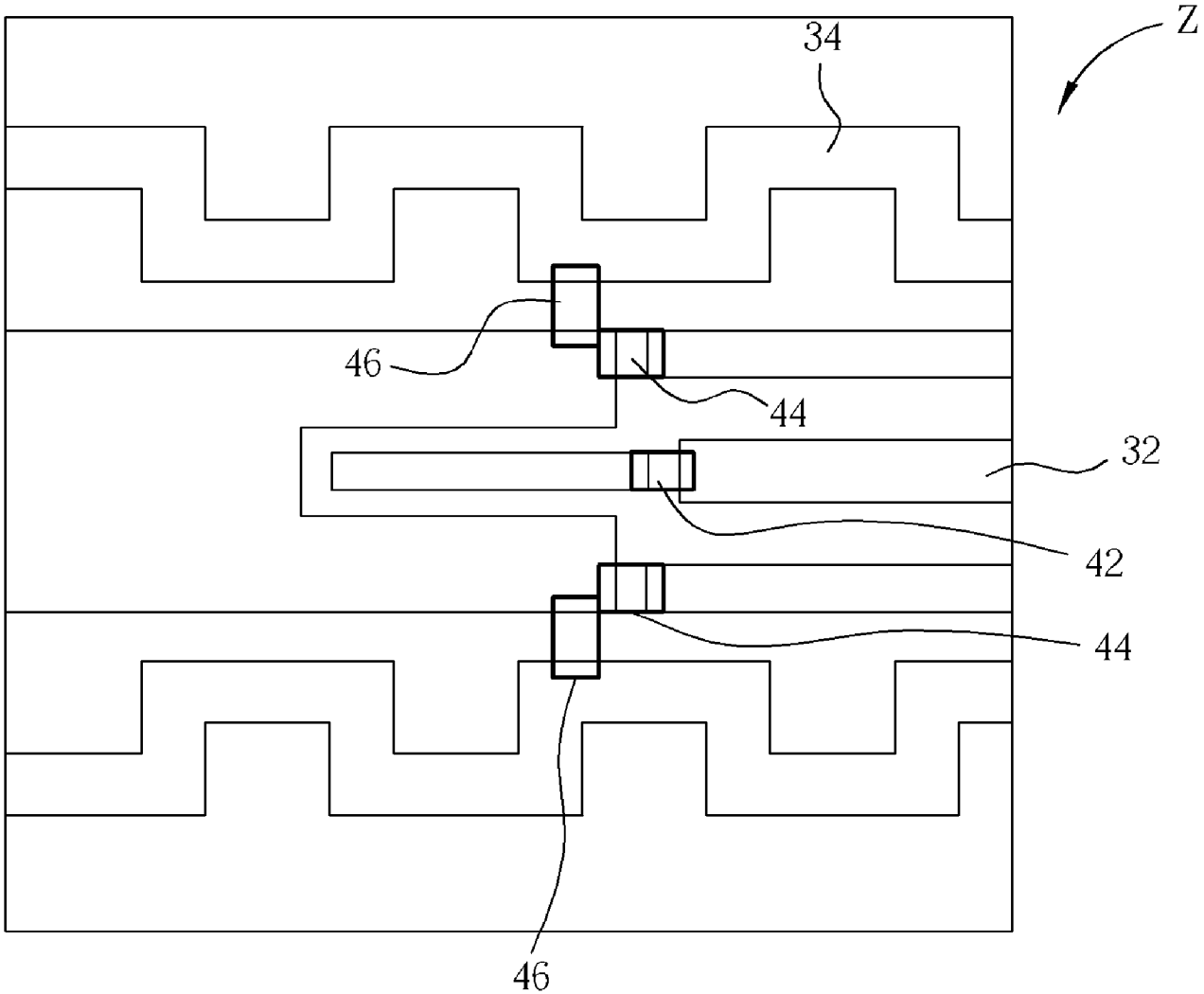
FIG. 4 is an illustration of an enlarged view of the printed sleeve monopole antenna according to the present invention.

Please refer to FIG. 3 and FIG. 4. FIG. 3 is an illustration of an exemplary embodiment of the printed sleeve monopole antenna 30 according to the present invention. FIG. 4 is an illustration of an enlarged view of zone Z in FIG. 3. The sleeve monopole antenna 30 comprises a radiator 32 and a ground element, which functions as a prior art sleeve and is called winding sleeve 34. Both the radiator 32 and the winding sleeve 34 stick on a substrate (film) 36 and therefore the radiator 32 in the exemplary embodiment is a printed film antenna capable of transmitting full band (88~108 MHz) FM radio signals. The winding sleeve 34 provides route for the inverse phase signals of the radio signals. The sleeve monopole antenna 30 further comprises a first matching element 42, a second matching element 44, and a third matching element 46. The first matching element 42 is disposed at one end of the radiator 32 for extending the resonant electrical length of the radiator 32. In the exemplary embodiment, the first matching element 42 is a passive element such as an inductance. The second matching element 44 is disposed at one end of the winding sleeve 34 and is a passive element such as an inductance, similar to the first matching element 42. The third matching element 46 is coupled between the front end and the back end of the winding sleeve 34, which means ground-to-ground, and is a passive element such as a resistance functioning as loaded impedance. Among the matching elements, the second matching element 44 and the third matching element 46 that coupled to the winding sleeve 34 exist in pairs in the winding sleeve 34. However, implementing a single second matching element 44 and a single third matching element 46 on the winding sleeve 34 is also an option.

The overall length of the radiator 32 approximates the resonant electrical length with ¼ wavelength. The plurality of winding sections 321 can reduce the size of the sleeve monopole antenna 30, while the first matching element 42 (inductance) connecting at the end of the radiator 32 can make up for the resonant electrical length of the radiator 32 after the length of the radiator 32 is further shortened. The winding sleeve 34 has an approximate overall resonant electrical length with ⅛ to ¼ wavelength. The 180 degree winding of the winding section 342 doubles the effectiveness of the route with fixed length L'. The plurality of winding sections 341 in the winding sleeve 34 reduce the size and the length of the winding sleeve 34 to the length L' in replacement with the prior art sleeve with length L. Additionally, the second matching element 44 (inductance) connecting at the front end of the winding sleeve 34 can make up for the resonant electrical length of the winding sleeve 34 after the length L' of the winding sleeve 34 is further shortened.

Figure 5:
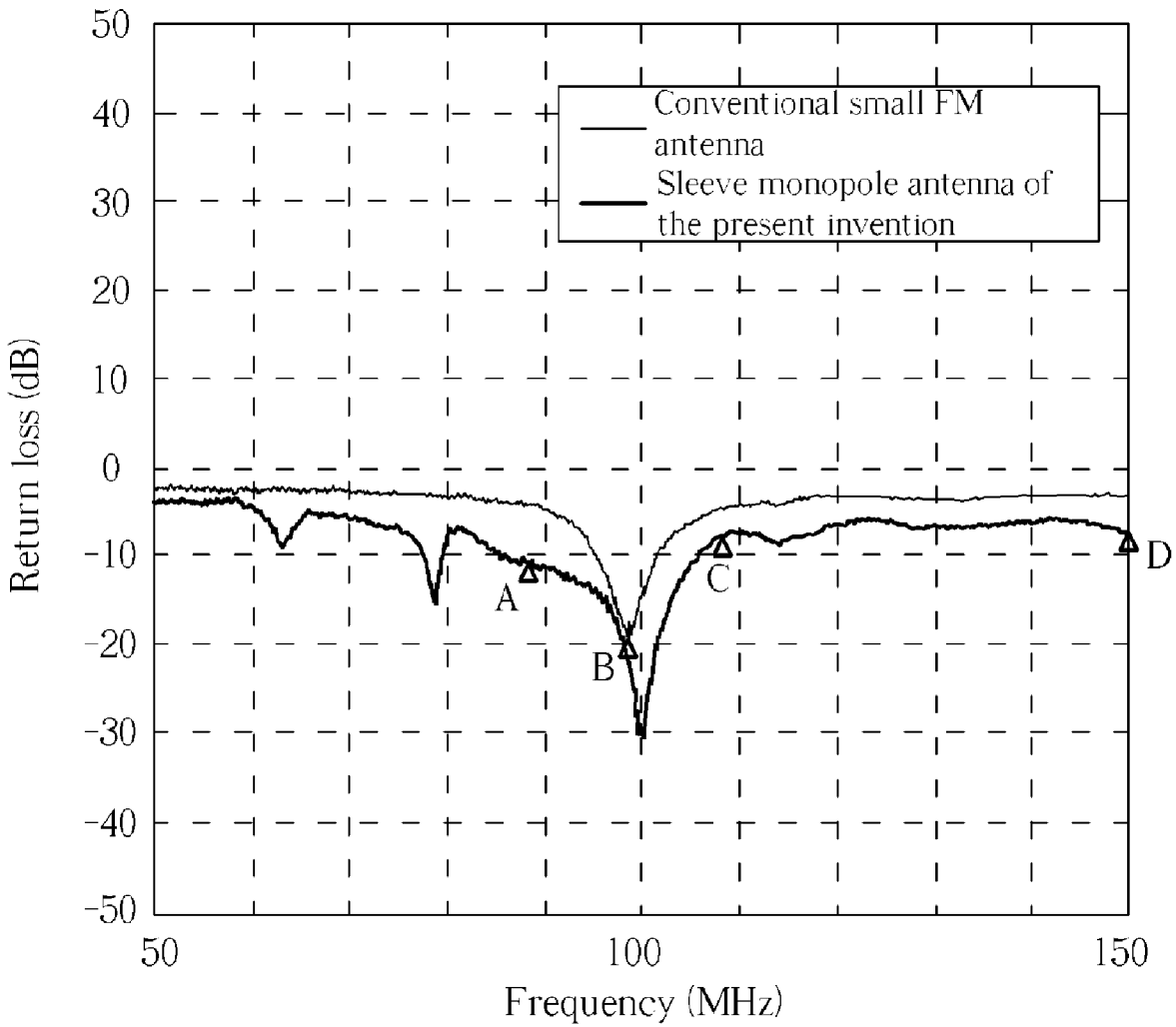
FIG. 5 is an illustration of a response diagram of the return loss to frequency of conventional small FM antenna and the sleeve monopole antenna of the present invention.

Please refer to FIG. 5. The response diagram of the return loss to frequency of conventional small FM antenna and the printed sleeve monopole antenna 30 is provided. The bandwidth of the sleeve monopole antenna 30 with return loss less than −10 dB is more than 20 MHz, which is far wider than that of conventional small FM antenna. In FIG. 5, point A is 88.1 MHz with return loss −10.965 dB, point B is 98.1 MHz with return loss −19.105 dB, point C is 107.9 MHz with return loss −7.986 dB, and point D is 150.0 MHz with return loss −7.273 dB. In the exemplary embodiment of the present invention, the length of the sleeve monopole antenna 30 can be reduced to 30 cm, with 2 cm in width, and since the antenna is realized by printed film antenna, the transparent, flexible, thin (about 0.4 mm) feature of the antenna is suitable for being stuck on the windows of a mobile. Please refer to FIG. 6. The figure shows an illustration of transmission power among different frequencies of a conventional small FM antenna and the sleeve monopole antenna 30 of the present invention. With constant output power of the transmitter, the sleeve monopole antenna 30 has larger transmission power than the conventional small FM antenna in 88.1 MHz, 98.1 MHz, 107.9 MHz, which include full band of FM signals, and is larger for about 11~25 dB in average. Additionally, the transmission power of the sleeve monopole antenna 30 within the full band section (88~108 MHz) varies more evenly (less than 4 dB) than that of the conventional small FM antenna (more than 15 dB).

Figure 1:
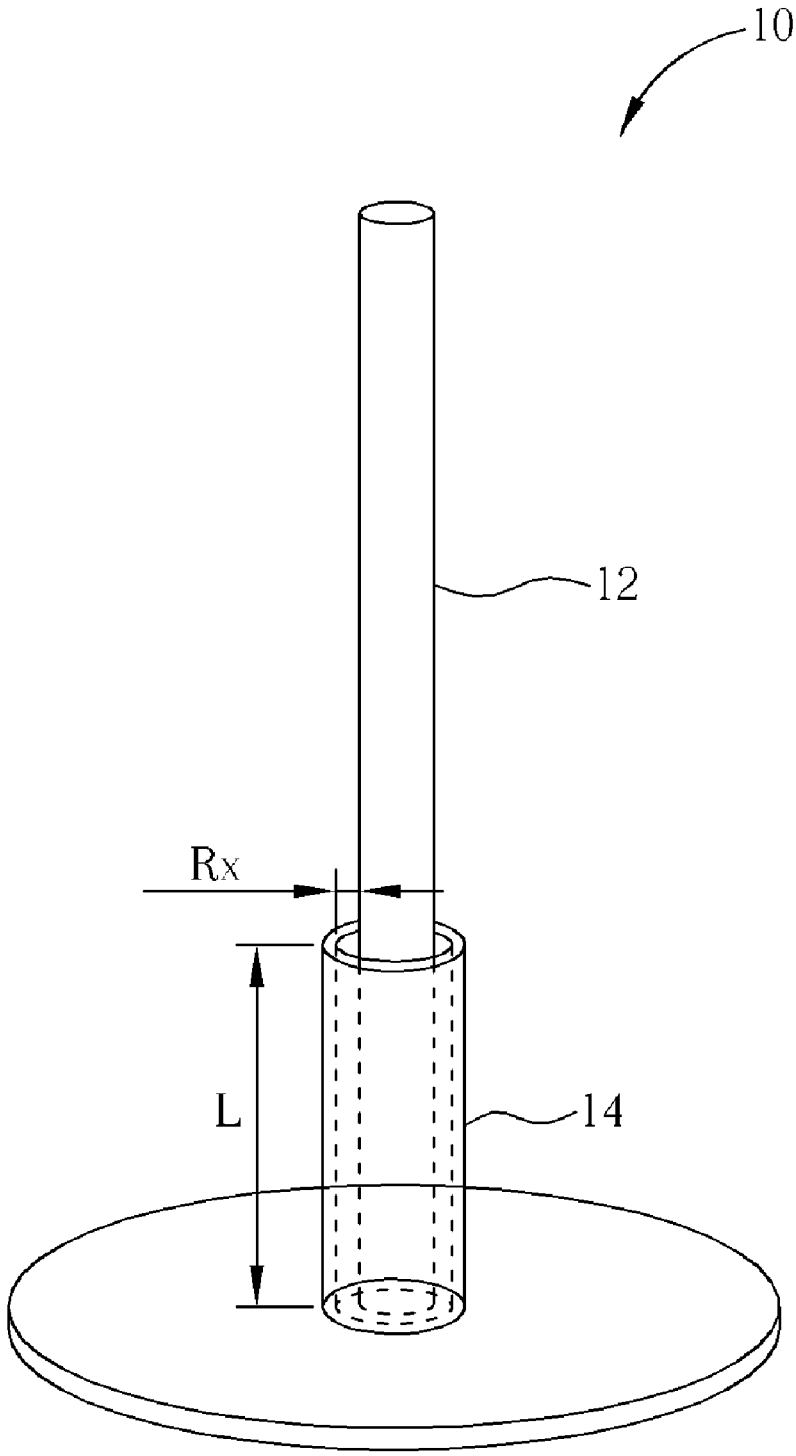
Fig. 1 Prior Art
FIG. 1 is an illustration of a sleeve monopole antenna according to the prior art.
Figure 2:
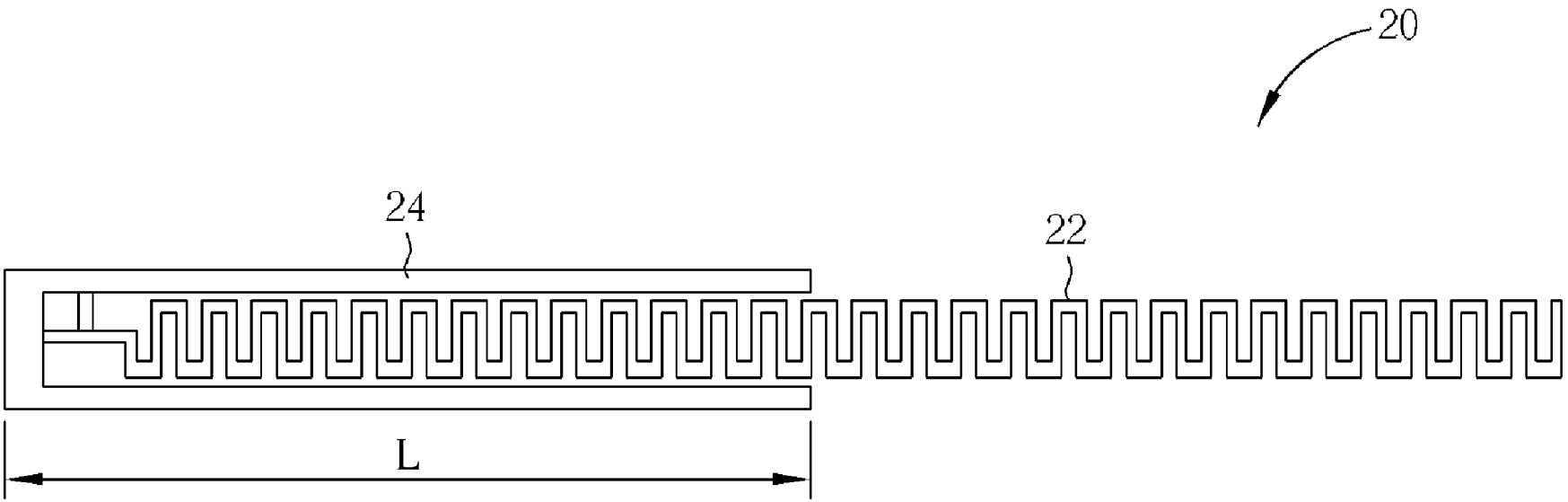
Fig. 2 Prior Art
FIG. 2 is an illustration of a printed sleeve monopole antenna according to the prior art.
Figure 7:
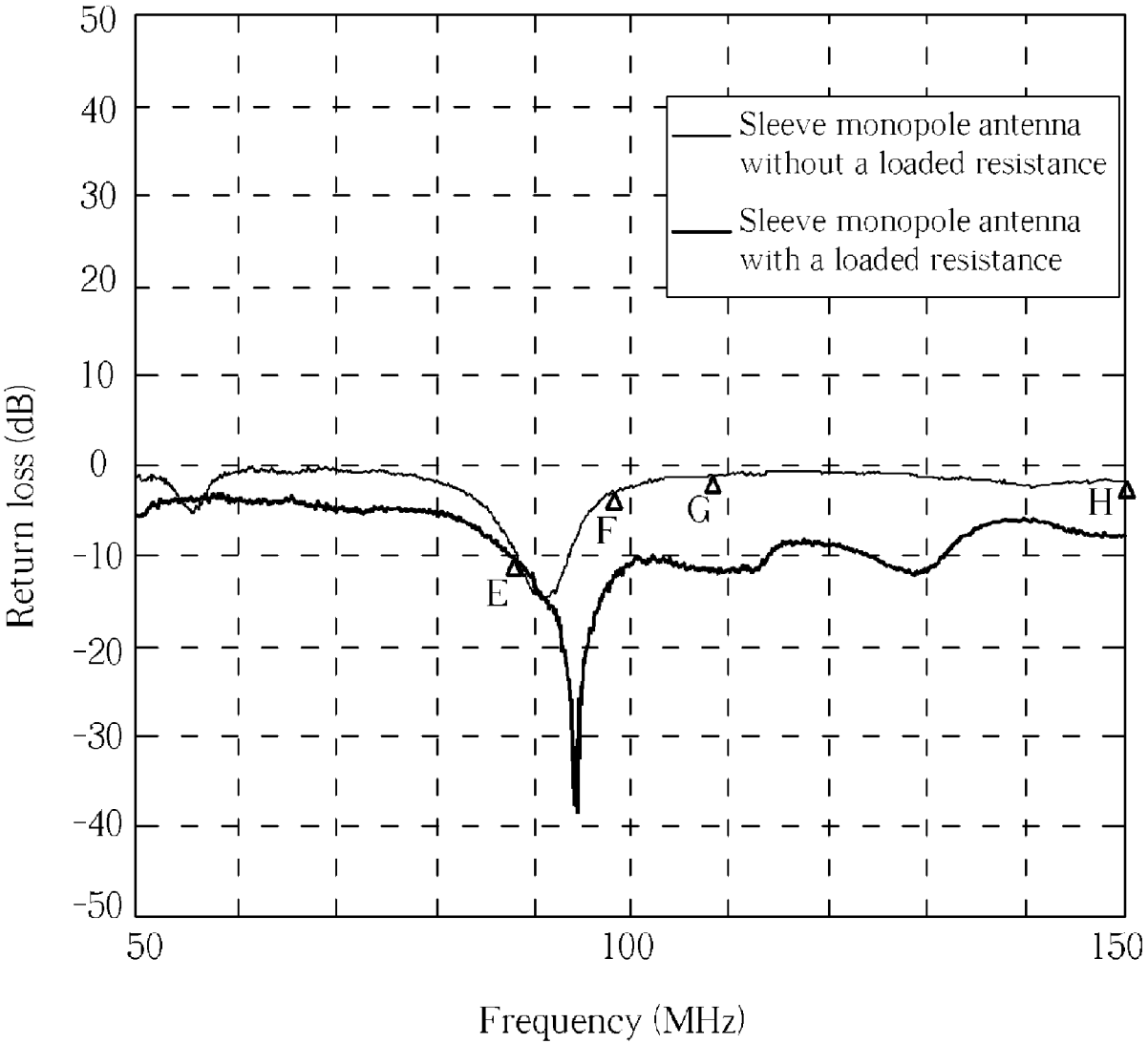
FIG. 7 is an illustration of a response diagram of the return loss to frequency of the sleeve monopole antenna without a loaded resistance and the sleeve monopole antenna with a loaded resistance.

When inductances (the first matching element 42 and the second matching element 44) are used for making up for the equivalent electrical lengths of the radiator 32 and the winding sleeve 34, the power of reflection signals at the ground section increases and flows to other elements or reflects on the antenna that causes mismatching of impedances, which therefore narrows down the effective bandwidth of the sleeve monopole antenna 30. The prior art sleeve monopole antenna 10 as in FIG. 1 has one end of the sleeve 14 connected with a large ground or another radiator with ¼ wavelength, while the present invention couples a resistance (the third matching element 46) between the front end and the back end of the winding sleeve 34 as a loaded impedance to absorb the counter current flowing through the winding sleeve 34. In such way, the effective bandwidth of the sleeve monopole antenna 30 broadened. Please refer to FIG. 7. FIG. 7 is an illustration of a response diagram of the return loss to frequency of the sleeve monopole antenna without a loaded resistance and the sleeve monopole antenna with a loaded resistance. In FIG. 7, point E is 88.1 MHz with return loss −9.938 dB, point F is 98.1 MHz with return loss −3.069 dB, point G is 107.9 MHz with return loss −1.369 dB, and point H is 150.0 MHz with return loss −1.206 dB. After the third matching element 46 (the resistance) is added to the winding sleeve 34, the bandwidth of the sleeve monopole antenna 30 with return loss less than −10 dB increases and the antenna 30 has even less return loss in a whole scale. With the third matching element 46, the sleeve monopole antenna 30 has wider available bandwidth, more even transmission power.

The sleeve monopole antenna of the present invention couples an inductance to an end of the radiator and a set of inductances to the sleeve for increasing the resonant electrical lengths of the radiator and the sleeve. A set of impedances is coupled to the sleeve to absorb the reflective power of the radiator for increasing the bandwidth of the antenna. The winding layout of radiator and sleeve and the disposition of passive elements (such as the inductance and the resistance) allow the sleeve monopole antenna for attaching on any part of a mobile with miniaturized design with full band FM radiation and only 35 centimeters long.

Those skilled in the art will readily observe that numerous modifications and alterations of the device and method may be made while retaining the teachings of the invention.

What is claimed is:

1. A full band sleeve monopole antenna with equivalent electrical length comprising:

a radiator having a plurality of winding sections and for transmitting a radio signal;

a ground element for providing route for the inverse phase signal of the radio signal, the ground element having a plurality of winding sections, a first end, and a second end;

a first matching element disposed at one end of the radiator;

a second matching element disposed at one end of the ground element; and a third matching element coupled between the first end and the second end of the ground element for providing an impedance.

2. The sleeve monopole antenna of claim 1 wherein the radiator is for transmitting a full band frequency modulation (FM) signal.

3. The sleeve monopole antenna of claim 1 wherein the radiator is a printed film antenna.

4. The sleeve monopole antenna of claim 1 wherein the length of the radiator approximates a resonant electrical length with ¼ wavelength.

5. The sleeve monopole antenna of claim 1 wherein the ground element is a winding sleeve.

6. The sleeve monopole antenna of claim 1 wherein the length of the ground element approximates a resonant electrical length with ⅛ to ¼ wavelength.

7. The sleeve monopole antenna of claim 1 wherein the first matching element, the second matching element, and the third matching element are passive elements.

8. The sleeve monopole antenna of claim 1 wherein the first matching element and the second matching element are inductances.

9. The sleeve monopole antenna of claim 1 wherein the third matching element is a resistance.

* * * * *